US005102141A

United States Patent [19]

Jordan

[11] Patent Number: 5,102,141

[45] Date of Patent: Apr. 7, 1992

[54] GOLF PUTTING PRACTICE DEVICE

[75] Inventor: Lawrence E. Jordan, South Holland, Ill.

[73] Assignee: Mulay Plastics Inc., Addison, Ill.

[21] Appl. No.: 380,794

[22] Filed: Jul. 17, 1989

[51] Int. Cl.[5] ..... A63B 57/00; A63B 69/36

[52] U.S. Cl. ..... 773/179 R; 273/179 A; 273/182 R; 273/182 A

[58] Field of Search ..... 273/179 R, 179 A, 179 B, 273/179 C, 179 D, 179 E, 182 R, 182 A

[56] References Cited

U.S. PATENT DOCUMENTS

| | | | |
|---|---|---|---|
| 1,558,766 | 10/1925 | Smith . | |
| 1,558,767 | 10/1925 | Smith . | |
| 2,308,785 | 1/1943 | Smith | 273/179 B |
| 2,443,759 | 6/1948 | Anderson | 273/179 A |
| 3,030,113 | 4/1962 | Brandell . | |
| 3,184,239 | 5/1965 | Heuser | 273/179 B |
| 3,264,000 | 8/1966 | Brown . | |
| 3,351,345 | 11/1967 | Robinette . | |
| 3,469,334 | 9/1969 | Kategian | 40/106.25 |
| 3,727,917 | 4/1973 | MacLean | 273/176 H |
| 3,856,313 | 12/1974 | Tierney | 273/179 C |
| 4,240,637 | 2/1980 | Cross et al. | 273/176 H |
| 4,563,009 | 1/1986 | Nagasaki et al. | 273/179 B |

FOREIGN PATENT DOCUMENTS

| | | | |
|---|---|---|---|
| 2147814 | 5/1985 | United Kingdom | 273/179 C |

OTHER PUBLICATIONS

Sheets of Photocopy of Package of Soko Golf Device (undated).

*Primary Examiner*—Edward M. Coven
*Assistant Examiner*—Raleigh W. Chiu

[57] ABSTRACT

A golf putting practice device has an elongate runner for supporting a rolling golf ball from a putting location at one end of the runner to a cup formed in the other end of the runner. An overshoot gutter is provided adjacent and beyond the cup and the cup and the gutter are connected in communication with a ball return structure by way of a ramp structure which guides golf balls to the ball return device. The ball return device includes a track which extends alongside the runner to the putting location.

9 Claims, 3 Drawing Sheets

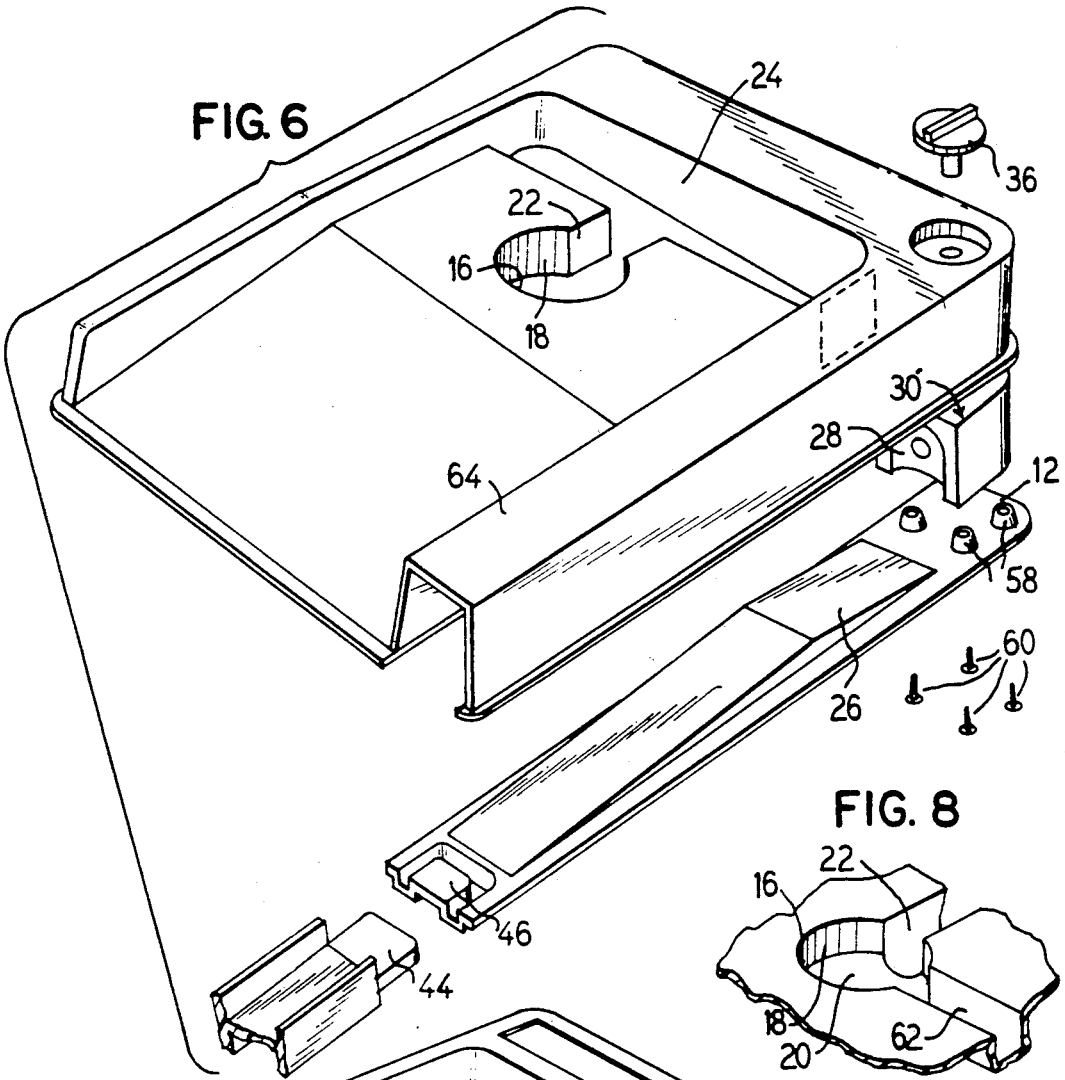
FIG. 6
FIG. 8
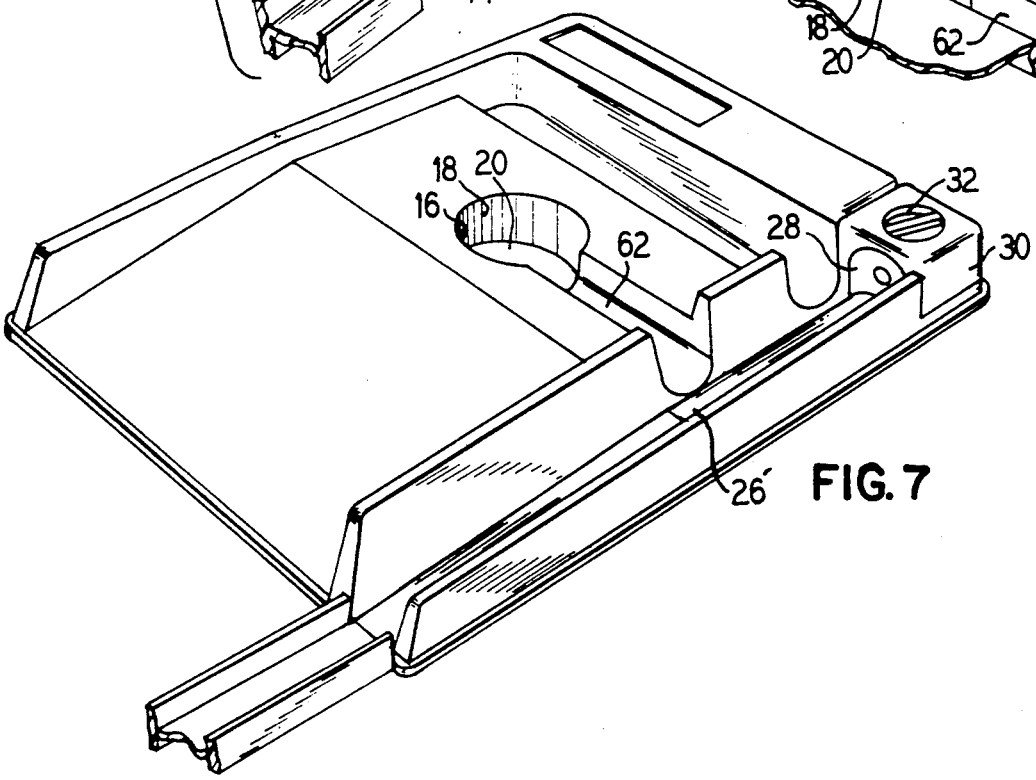
FIG. 7

GOLF PUTTING PRACTICE DEVICE

BACKGROUND OF THE INVENTION

1. Field of the Invention

The present invention relates to a golf putting practice device and is more particularly concerned with a golf putting practice device which returns a golf ball to a putting location.

2. Description of the Prior Art

Many golf putting practice devices are on the market, including devices in which the player attempts to score by making a putt from designated distance.

Most of the known devices return a golf ball towards a putting location under the influence of gravity. With these devices, a golf ball is putted up an inclined surface to be received through a hole and be discharged through a chute such that the potential energy of the golf ball at the height of the hole is converted into kinetic energy to return of the ball towards the putting area.

SUMMARY OF THE INVENTION

The object of the present invention is to provide a golf putting practice device which is realistic and with which a putting green may be simulated and which returns a golf ball to a putting location.

According to the invention, a golf putting practice device is provided which includes a base which supports a platform having a hole therein for receiving a putted golf ball. The platform also has a trough for receiving balls which roll past the hole. The trough has a floor which is inclined towards a ball receiving device and which communicates with the floor beneath the hole so as to direct golf balls towards the golf receiving device. The ball receiving device is generally outside of the playing area and includes a kicker for propelling a golf ball towards the original putting location. The kicker is generally that disclosed by John R. Brandell in U.S. Pat. No. 3,030,113 and comprises an actuator which, when struck by a golf ball, triggers a solenoid whose plunger kicks and propels the golf ball towards the putting location guided by a gutter or track.

A golf putting practice device constructed in accordance with the present invention also comprises a runner which, at its distal end, covers the floor of the platform and has a hole therethrough registering with the hole in the platform. At its proximal end, the runner comprises the putting location. The runner may be in the form of a flexible carpet to be received on a supporting surface so that it may be provided with rises, falls or undulations to simulate an actual putting surface.

BRIEF DESCRIPTION OF THE DRAWINGS

Other objects, features and advantages of the invention, its organization, construction and operation will be best understood from the following detailed description, taken in conjunction with the accompanying drawings, on which:

FIG. 6 is a pictorial exploded view of another apparatus constructed in accordance with the present invention;

FIG. 7 is a perspective view of another embodiment of the invention; and

FIG. 8 is a fragmentary perspective view of another embodiment of the invention showing side and rear ball exits.

DESCRIPTION OF THE PREFERRED EMBODIMENTS

Figure 1:
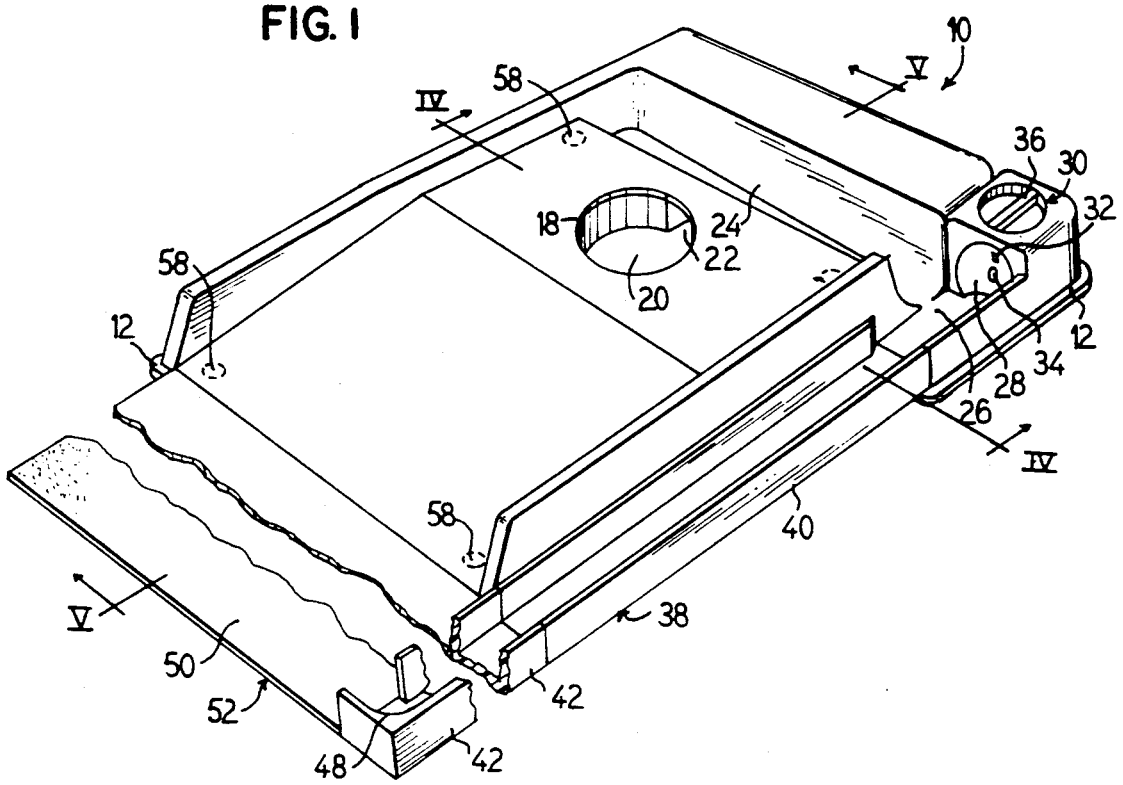
FIG. 1 is a perspective view of a golf putting practice device constructed in accordance with the present invention.

Referring to the drawings, particularly FIG. 1 a golf putting practice device is illustrated as comprising basically two parts. The first part contains the cup and the elements, one including a cup and the second part containing a putting surface including a putting location.

The device is generally illustrated at 10 as comprising a base 12 including a platform 14 (FIG. 3) having a hole 16 therein with a vertical sidewall 18 and a bottom 20 which generally constitutes the cup. The cup 20 communicates with a ball receiver 28 by way of a rear exit passage 22 beneath the floor and an overshoot gutter 24 spaced rearwardly of the cup. The floor 20, the passageway 22 and the gutter 24 together extend at a downward and rearward angle to the ball receiver 28 and are in communication therewith by way of a rearwardly and downwardly extending ramp 26. The ball receiver 28 is shown as a convex element and may advantageously be a part of a module 30 constructed in accordance with U.S. Pat. No. 3,030,113, fully incorporated herein by this reference. The module 30 is a kicker device for striking a golf ball to propel the same back towards the putting location and may comprise an actuating element 32 which is triggered by the entrance of a golf ball into the ball receiver to operate a solenoid (not shown) which has a piston 34 for striking the golf ball. The striking force may be adjusted by way of a control 36. Further details may be obtained by referring to the aforementioned U.S. Pat. No. 3,030,113. When a golf ball is struck by the piston 34, it is propelled up the ramp 26 and onto a return ball track which includes a section 40 fixed to the base and a plurality of sections 42 which are interconnected therewith to extend along the length of a runner 52 which carries the putting locating 50. The interconnection structure is illustrated in FIG. 6 as comprising a flexible hollow tongue 44 to be received in a groove 46. This structure is provided at each junction of the sections.

The end track 42 comprises a curved surface 48 which guides the ball transversely of the track and onto the putting location.

The runner 52 is advantageously flexible so as to simulate an actual putting green so as to include ridges and undulations.

Figure 2:
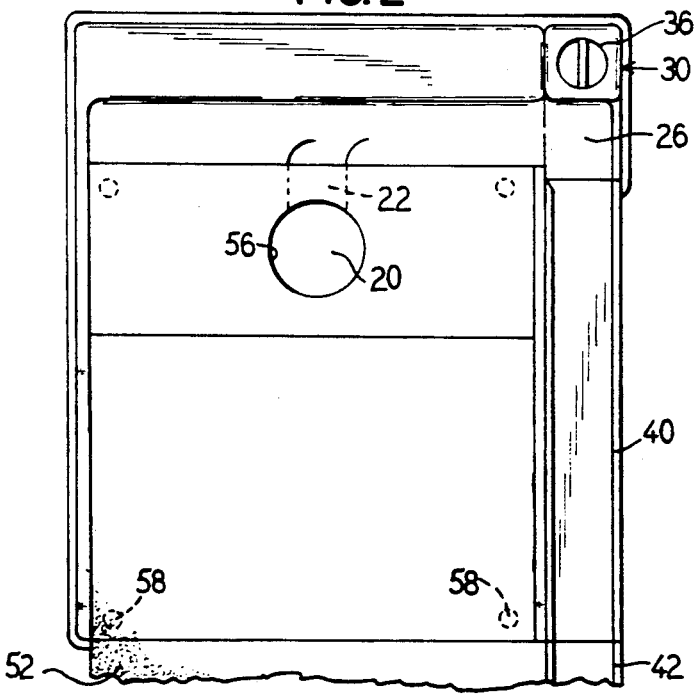
FIG. 2 is a plan view of the apparatus illustrated in FIG. 1.
Figure 4:
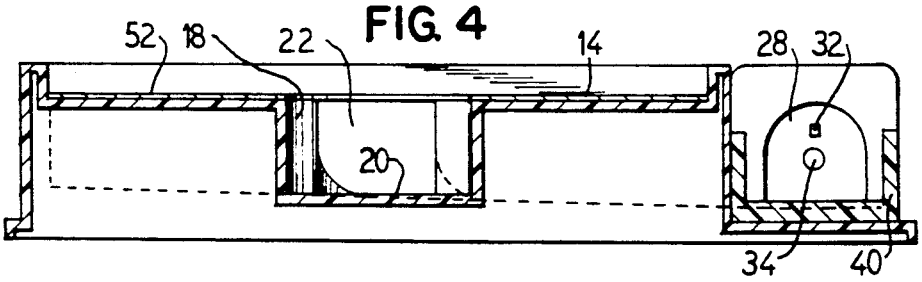
FIG. 4 is a sectional view taken substantially along the line IV—IV of FIG. 1.
Figure 5:
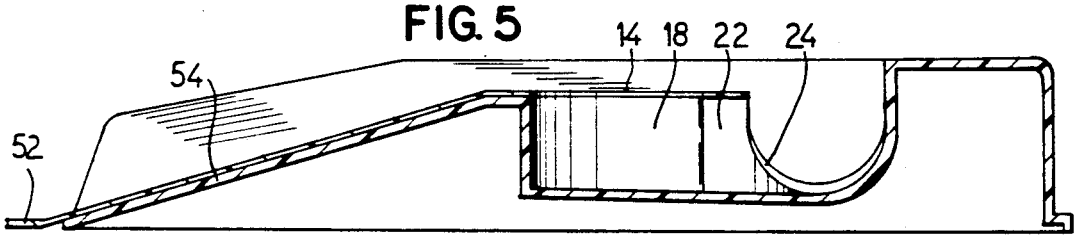
FIG. 5 is a fragmentary view taken substantially along the line V—V of FIG. 1.

The runner 52 also includes a hole 56 which is registered with the hole 16 (see FIG. 2). The platform 14 is raised to accommodate the cup and is integral with a ramp 54 which extends from the platform 14 to a location adjacent the supporting surface at the forward end of the device. The runner 52 may be glued to the ramp 54 and the platform 14 or it may be attached thereto by way of flexible fasteners 58 which have compressible shanks for extending through holes and then expanding beyond the holes.

Referring to FIG. 6, a different embodiment of the invention is illustrated in which the ball receiver 28 is a portion of a separate module 30' which is not integral with the base 12. Here, the module 30' includes a plurality of recesses in the bottom thereof for receiving corresponding bosses 58 and is secured to the base 12 by way of a corresponding plurality of screws 60.

All of the structure described thus far relates to a device in which the golf ball exits from the rear of the cup. Referring to FIG. 7, a side exit is provided. Here again, the cup is constituted by a hole 16, a circular sidewall 18 and a bottom 20. The cup is placed in communication with the ball receiver 28 by way of a downwardly sloping side exit passageway 62 and a ramp 26' which is longer than the ramp 26.

Referring to FIG. 8, both a rear exit and a side exit may be provided. In this embodiment, the cup would communicate with the ball receiver 28 by way of the rear passageway 22 and by way of the side passageway 62.

Figure 3:
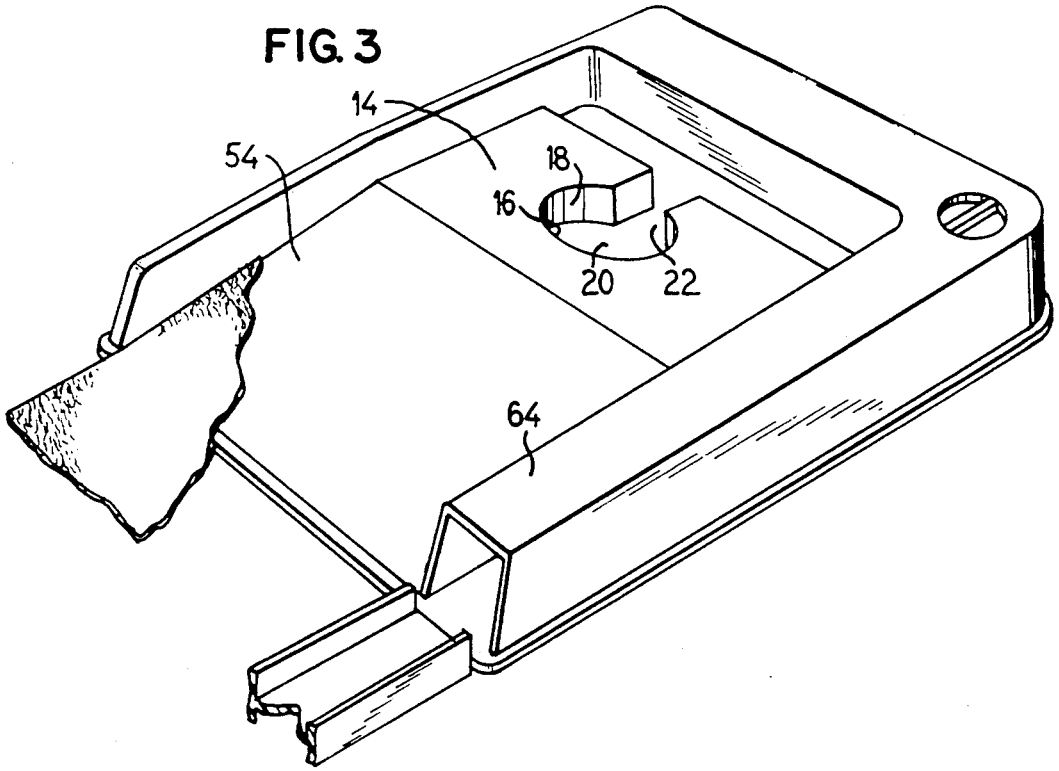
FIG. 3 is a fragmentary perspective view of the apparatus illustrated in FIG. 1.

As best seen in FIGS. 3 and 6 a cover may be provided for the initial portion of the ball return track, the cover 64 being molded integral with the floor (platform) and the ramp 54.

Other objects, features and advantages of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A golf putting practice device comprising:

a base for placement on and to be supported by a supporting surface and including a front and a rear;

a floor carried by said base spaced above the supporting surface in a generally horizontal orientation, said floor including a first hole therethrough;

a front ramp extending from said front of said base up to said floor;

an elongate flexible runner which is manipulatable as desired to simulate an uneven putting surface, said elongate runner including a proximal end, a ball putting first area adjacent said proximal end, a distal end and a second area adjacent said distal end covering said front ramp and said floor, said second area including a second hole therethrough aligned with said first hole through said floor for receiving golf balls therethrough and to simulate a cup;

a gutter system supported by said base for guiding golf balls and extending at a downward slope from a first location beneath said first and second holes to a second location; and ball return means including ball receiving means at said second location, a kicker mounted to said base adjacent said ball receiving means for propelling a golf ball toward said putting area of said runner, and kicker actuating means for operating said kicker in response to entry of a golf ball into said ball receiving means, said gutter system comprising a first gutter located between said floor and said rear of said base and in communication with said ball receiving means, and a second gutter extending from said first location to and opening into said first gutter.

2. The golf putting practice device of claim 1, and further comprising:

a ball-return track extending along and being supported by the supporting surface, said ball-return track including a first end in communication with said kicker for receiving and guiding a golf ball propelled by said kicker, and a second end adjacent said putting first area of said flexible runner.

3. The golf putting practice device of claim 2, wherein said ball-return track includes arcuate ball exit means at said second end of said track for directing a golf ball onto said putting first area of said runner.

4. The golf putting practice device of claim 2, wherein said ball-return track comprises:

a pair of spaced sidewalls and a track floor between said sidewalls.

5. The golf putting practice device of claim 1, wherein said base comprises:

first and second sidewalls extending from said front to said rear with said floor and said front ramp therebetween;

said first sidewall including a top extending above and beyond said floor and said first sidewall developing into a rear wall of said first gutter;

said second sidewall extending rearwardly from said front to an intersection with said first gutter; and said side ramp extending adjacent said second side wall.

6. The golf putting practice device of claim 5, wherein:

said second sidewall comprises a pair of spaced walls and a top therebetween forming a tunnel covering said side ramp.

7. The golf putting practice device of claim 1, and further comprising:

a detachable module mounted to said base, said module comprising a housing, said kicker mounted in said housing, said housing comprising a wall including a spherical recess therein, third and fourth holes extending through said recess, said kicker actuator extending through said third hole, and said kicker including a plunger extending and extensible through said fourth hole.

8. A golf putting practice device comprising:

a base for placement on and to be supported by a supporting surface and including a front and a rear;

a floor carried by said base spaced above the supporting surface in a generally horizontal orientation, said floor including a first hole therethrough;

a front ramp extending from said front of said base up to said floor;

an elongate flexible runner which is manipulatable as desired to simulate an uneven putting surface, said elongate runner including a proximal end, a ball putting first area adjacent said proximal end, a distal end and a second area adjacent said distal end covering said front ramp and said floor, said second area including a second hole therethrough aligned with said first hole through said floor for receiving golf balls therethrough and to simulate a cup;

a gutter system supported by said base for guiding golf balls and extending at a downward slope from a first location beneath said first and second holes to a second location; and ball return means including ball receiving means at said second location, a kicker mounted to said base adjacent said ball receiving means for propelling a golf ball towards said putting area of said runner, and kicker actuating means for operating said kicker in response to entry of a golf ball into said ball receiving means;

said gutter system comprising a side ramp connected to said base and extending downwardly and rearwardly to communicate with said ball receiving means, a first gutter located between said floor and said rear of said base and in communication with said side ramp, and a second gutter extending from said first location and in communication with an opening into said first gutter.

9. A golf putting practice device comprising:

a base for placement on and to be supported by a supporting surface and including a front and a rear;

a floor carried by said base spaced above the supporting surface in a generally horizontal orientation, said floor including a first hole therethrough;

a front ramp extending from said front of said base up to said floor;

an elongate flexible runner which is manipultable as desired to simulate an uneven putting surface, said elongate runner including a proximal end, a ball putting first area adjacent said proximal end, a distal end and a second area adjacent said distal end covering said front ramp and said floor, said second area including a second hole therethrough aligned with said first hole through said floor for receiving golf balls therethrough and to simulate a cup;

a gutter system supported by said base for guiding golf balls and extending at a downward slope from a first location beneath said first and second holes to a second location; and ball return means including ball receiving means at said second location, a kicker mounted to said base adjacent said ball receiving means for propelling a golf ball toward said putting area of said runner, and kicker actuating means for operating said kicker in response to entry of a golf ball into said ball receiving means, said gutter system comprising an elongate side ramp connected to said base and extending downwardly and rearwardly to communicate with said ball receiving means, a first gutter located between said floor and said rear of said base and in communication with said elongate side ramp, a second gutter extending from said first location to and in communication with and opening into said first gutter, and a third gutter extending from said first location at an angle with respect to said second gutter to and in communication with said elongate side ramp.

* * * * *